US008029208B1

(12) United States Patent
Lee et al.

(10) Patent No.: US 8,029,208 B1
(45) Date of Patent: Oct. 4, 2011

(54) APPARATUS AND METHOD FOR COVERING A SURFACE OF A BODY OF WATER TO INHIBIT EVAPORATION

(75) Inventors: Darin Michael Lee, Phoenix, AZ (US); Ari Gabriel Partanen, Tempe, AZ (US); Tamara Butler Johndrow, Phoenix, AZ (US); Timothy George Robinson, Scottsdale, AZ (US); William Arthur Ebert, Tucson, AZ (US); Eric William Ebert, Tucson, AZ (US); Todd Jason Ebert, Tucson, AZ (US)

(73) Assignee: Freeport-McMoRan Copper & Gold Inc., Phoenix, AZ (US)

( * ) Notice: Subject to any disclaimer, the term of this patent is extended or adjusted under 35 U.S.C. 154(b) by 363 days.

(21) Appl. No.: 12/189,467

(22) Filed: Aug. 11, 2008

(51) Int. Cl.
*B65D 88/34* (2006.01)

(52) U.S. Cl. ..... 405/63

(58) Field of Classification Search ..... 4/498; 220/216, 220/218; 126/565, 566; 405/52, 53, 63
See application file for complete search history.

(56) References Cited

U.S. PATENT DOCUMENTS

| | | | | |
|---|---|---|---|---|
| 1,674,039 | A | 6/1928 | Glass | |
| 3,070,419 | A | 12/1962 | Malick | |
| 3,462,040 | A | 8/1969 | Galloway | |
| 3,842,768 | A | 10/1974 | Maistre | |
| 3,872,522 | A | 3/1975 | Bennett et al. | |
| 3,893,443 | A | 7/1975 | Smith | |
| 3,938,338 | A | 2/1976 | Cullen | |
| 3,998,204 | A | 12/1976 | Fuchs et al. | |
| 4,066,400 | A | 1/1978 | Cox et al. | |
| 4,189,058 | A | 2/1980 | Seliskar et al. | |
| 4,222,366 | A | 9/1980 | Acker | |
| 4,270,232 | A | 6/1981 | Ballew | |
| 4,366,806 | A | 1/1983 | Acker | |
| 4,542,715 | A | 9/1985 | DeRoos | |
| 4,749,606 | A | 6/1988 | Moore | |
| 4,786,205 | A | 11/1988 | Hisken et al. | |
| 6,986,227 | B1 * | 1/2006 | Gavin | 52/20 |
| 2008/0000903 | A1 * | 1/2008 | Cap et al. | 220/216 |

FOREIGN PATENT DOCUMENTS

JP 52001523 A * 1/1977

* cited by examiner

*Primary Examiner* — Sunil Singh
(74) *Attorney, Agent, or Firm* — Parsons & Goltry; Robert A. Parsons; Michael W. Goltry

(57) ABSTRACT

A cover structure for covering a portion of a surface of a body of water includes a first plate having a brim, a second plate having a brim, the second plate overlying and spaced apart from the first plate, a support structure coupling the first plate to the second plate, and the cover structure having a specific gravity for maintaining the first plate in a position covering a portion of the surface of a body of water, and maintaining the second plate below the portion of the surface of the body of water.

18 Claims, 7 Drawing Sheets

APPARATUS AND METHOD FOR COVERING A SURFACE OF A BODY OF WATER TO INHIBIT EVAPORATION

FIELD OF THE INVENTION

This invention relates to evaporation prevention devices.

More particularly, the present invention relates to units used in concert to cover a surface of a body of water.

BACKGROUND OF THE INVENTION

In the field of water conservation, preventing evaporation from bodies of water is becoming increasingly important. As populations increase, the pressure on natural resources, such as water, also increases. Industries such as mining and farming are also important users of this essential resource. Water lost through evaporation is lost as surely as if it was used. To replace this lost water, replacement water must be provided or purchased. With the pressures placed on water by increasing populations and industry, not only is water becoming increasingly expensive, it is also beginning to be apportioned and controlled. Thus, in many instances, any water lost through evaporation is simply gone and cannot be replaced. This can result in the production of many industries being limited by water availability. Increasing production is a matter of providing more water or increased efficiency using the water available.

Efficiency of water use is currently being increased through reclamation and various conservation techniques. In many cases, water is collected in surface water reservoirs. Evaporation of water from these bodies of water is a problem that has resulted in many and varied solutions. Many of these solutions include a covering over the water. Current coverings include floating covers, discrete floating elements such as balls (bird balls) and floating modules, and chemical monolayers. Each of these techniques has its drawbacks and advantages. Floating covers are generally a single sheet of material pulled over the surface of the body of water. While effective in covering a high percentage of the surface, this technique is difficult to manipulate on large bodies of water. Chemical mono layers are relatively cheap, but less effective at reducing evaporation than a cover, and are difficult to separate from the water. Discrete floating elements can be used on large bodies of water, are easy to add and remove, but typically have a limit to the coverage possible. A commonly used floating element is a hollow sphere often referred to as "bird balls". While somewhat effective, the ball shape leaves gaps between adjacent balls reducing there evaporation prevention effectiveness. Additionally, a great many balls are required to cover a body of water, and these balls can be expensive to produce. Other shapes of floating elements have been developed to increase the coverage, but none has been more effective than the ball shape.

It would be highly advantageous, therefore, to remedy the foregoing and other deficiencies inherent in the prior art.

An object of the present invention is to provide a discrete element cover which when used in numbers, has a higher percentage covering capacity.

Another object of the present invention is to provide a cover structure which is relatively inexpensive to produce.

Yet another object of the present invention is to provide a cover structure which is simple to use.

SUMMARY OF THE INVENTION

Briefly, to achieve the desired objects and advantages of the instant invention, provided is a cover structure for covering a portion of a surface of a body of water. The cover structure includes a first plate having a brim and a second plate having a brim. The second plate overlies and is spaced apart from the first plate. A support structure couples the first plate to the second plate. The cover structure has a specific gravity for maintaining the first plate in a position covering a portion of the surface of a body of water and for maintaining the second plate below the portion of the surface of the body of water. In a specific aspect, the brim portion of the first plate and the brim portion of the second plate define a maximum overlap with an adjacent cover structure.

In a more particular aspect, a cover structure for covering a portion of a surface of a body of water includes a first plate having an inner surface, an opposing outer surface, and a perimetric edge, and a second plate having a inner surface, an opposing outer surface, and a perimetric edge. The second plate overlies the first plate with the inner surface of the first plate facing the inner surface of the second plate in a spaced apart relationship. A support structure extends between the inner surface of the first plate and the inner surface of the second plate, fixing the first plate to the second plate. The support structure is spaced inwardly from the perimetric edge of the first plate and the second plate. A specific gravity of the cover structure is for maintaining one of the first plate and the second plate in a position covering a portion of the surface of a body of water, and maintaining the other of the first plate and the second plate below the portion of the surface of the body of water.

In yet another aspect, a cover assembly for covering a surface of a body of water is provided. The cover assembly includes a first cover structure and a second cover structure. The first cover structure includes a first plate overlying and spaced apart from a second plate, a support structure coupling the first plate to the second plate, the first plate having a brim and the second plate having a brim, the first cover having a specific gravity for maintaining the first plate in a position covering a portion of the surface of a body of water, and maintaining the second plate below the portion of the surface of the body of water. The second cover structure is positioned adjacent the first cover structure and includes a first plate overlying and spaced apart from a second plate, a support structure coupling the first plate to the second plate, the first plate having a brim and the second plate having a brim, the second cover having a specific gravity for maintaining the first plate in a position covering an adjacent portion of the surface of the body of water, and maintaining the second plate below the adjacent portion of the surface of the body of water. The brim of the first plate of the first covering and the brim of the second plate of the first cover overlap the brim of the first plate of the second covering and the brim of the second plate of the second cover.

BRIEF DESCRIPTION OF THE DRAWINGS

Specific objects and advantages of the instant invention will become readily apparent to those skilled in the art from the following detailed description of a preferred embodiment thereof taken in conjunction with the drawings, in which.

DETAILED DESCRIPTION OF THE PREFERRED EMBODIMENTS

Figure 1:
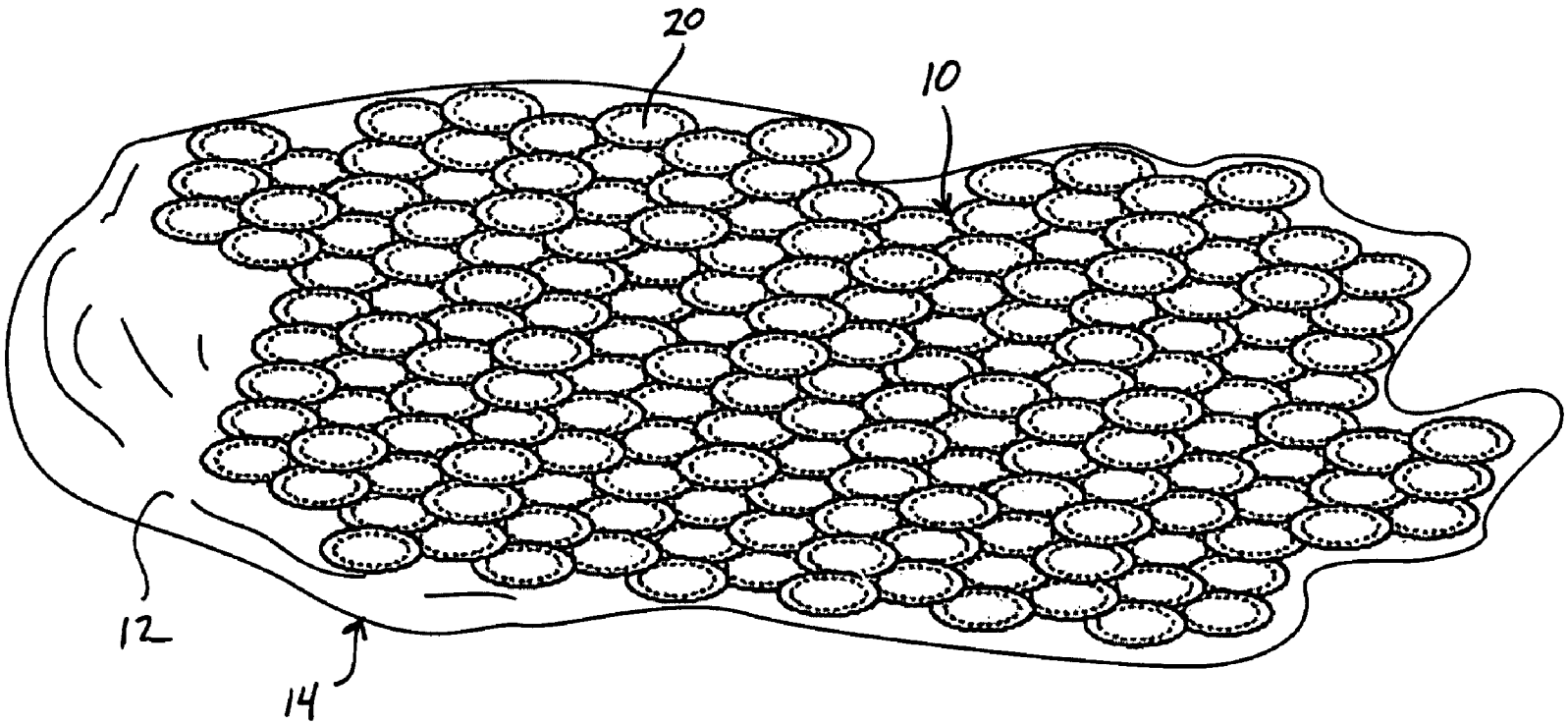
FIG. 1 is a perspective view of a cover assembly covering the surface of a body of water according to the present invention.

Turning now to the drawings in which like reference characters indicate corresponding elements throughout the several views, attention is first directed to FIG. 1 which illustrates a cover assembly generally designated 10, covering a surface 12 of a body of water 14. Cover assembly 10 includes a plurality of cover structures 20 which will be described in greater detail herein, and is uniquely structured to increase the coverage of surface 12 to approximately 100%, omitting irregularities of the edges of body of water 14. The complete coverage of surface 12 is possible, due to the overlapping features of cover structures 20. It will be understood by those skilled in the art that while body of water 14 is described using the term "water", other materials found in bodies of water associated with reclamation ponds, tailings ponds, and the like, as well as canals, lakes, etc. are intended to be included. Many may include reagents and other materials for which the prevention of evaporation is also desirous.

Figure 2:
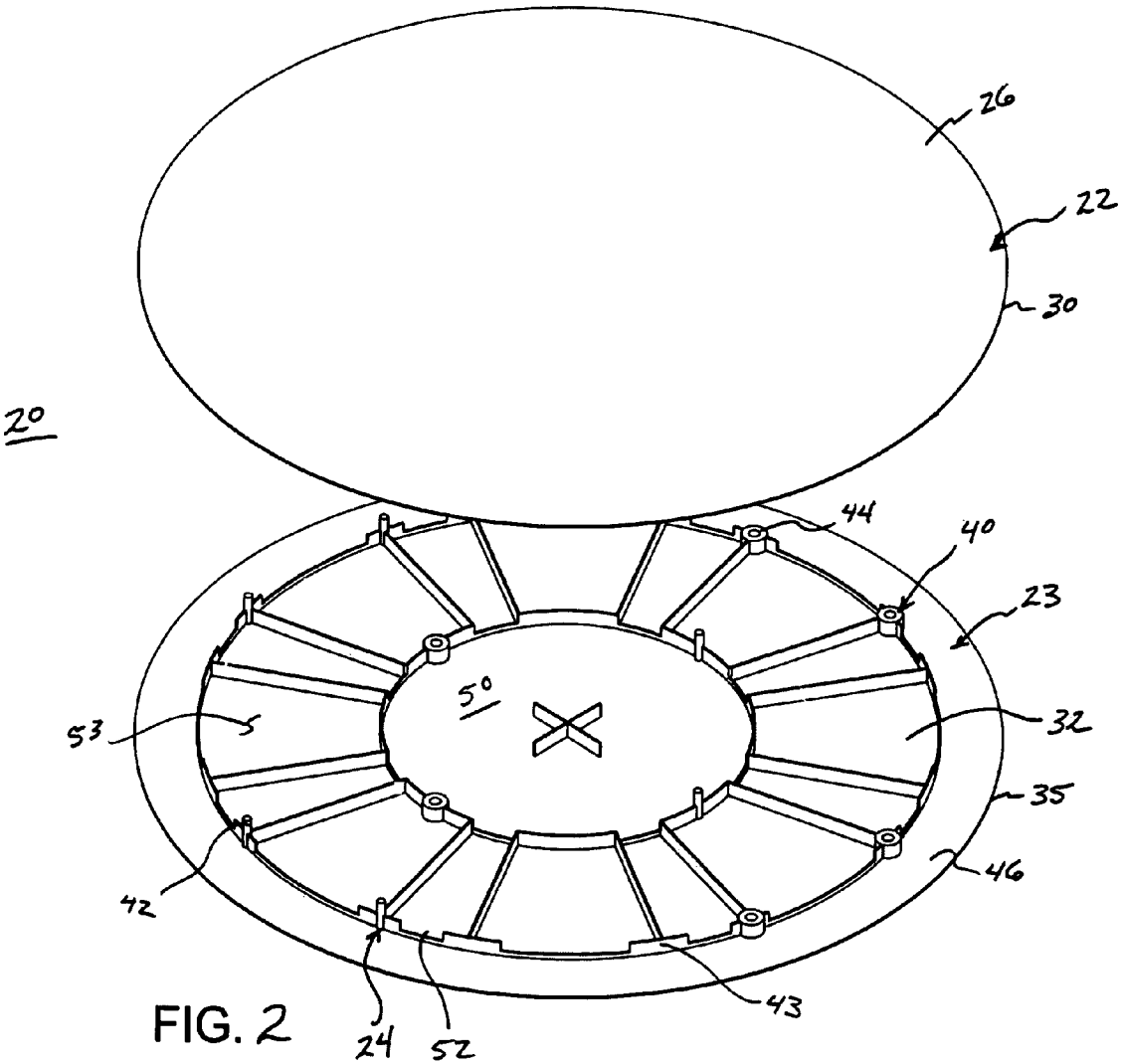
FIG. 2 is an exploded perspective view of a cover structure according to the present invention.
Figure 3:
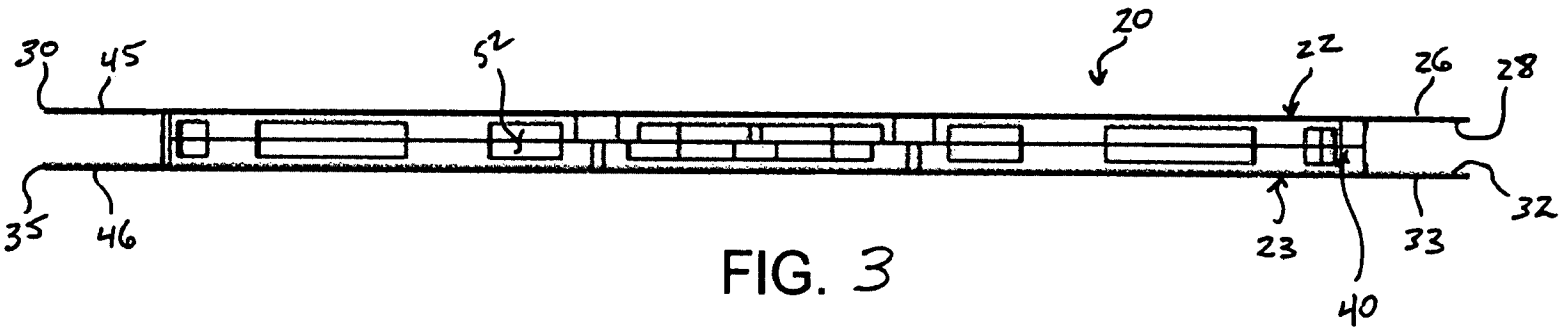
FIG. 3 is a side elevation of the cover structure of FIG. 2.
Figure 4:
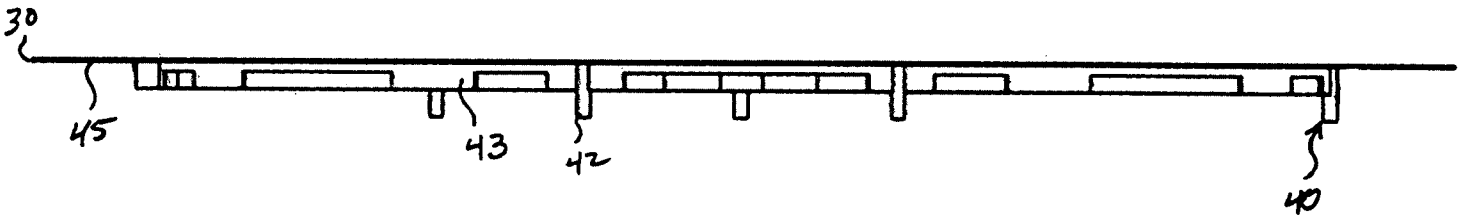
FIG. 4 is an exploded side view of the cover structure of FIG. 2.
Figure 4:
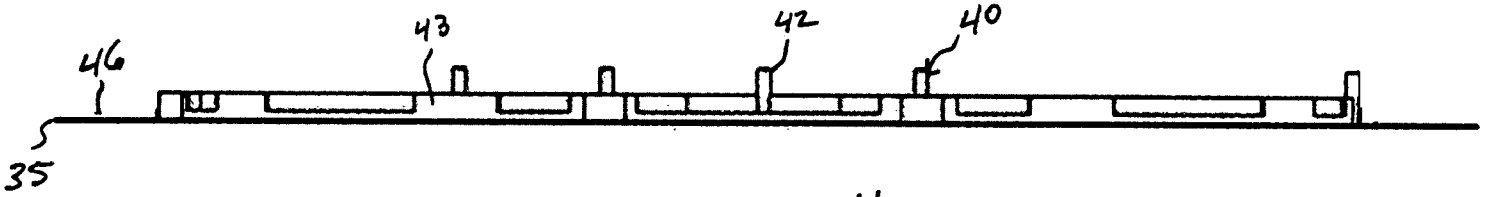

Referring now to FIGS. 2, 3, and 4, cover structure 20 is illustrated. Cover structure 20 includes a plate 22, a plate 23, and a support structure 24 coupling plate 22 to plate 23 such that they are in an overlying spaced apart relationship. Plate 22 includes an outer surface 26, an opposing inner surface 28, and a perimetric edge 30. Plate 23 includes an inner surface 32, an opposing outer surface 33, and a perimetric edge 35. Plate 22 is positioned overlying plate 23 with inner surface 28 of plate 22 facing inner surface 32 of plate 23 in a spaced apart relationship. A support structure 40 extends between inner surface 28 and inner surface 32 fixing plate 22 to plate 23. In the preferred embodiment, support structure 40 includes posts 42 and walls 43 spaced inwardly from perimetric edges 30 and 35 of plates 22 and 23. Also, preferably, outer surfaces 26 and 33 are slightly convex, to shed water toward perimetric edges 30 and 35. A flat portion can be formed centrally on the outer surfaces 26 and 33 to facilitate stacking for transport, without adversely affecting their water shedding ability.

Figure 5:
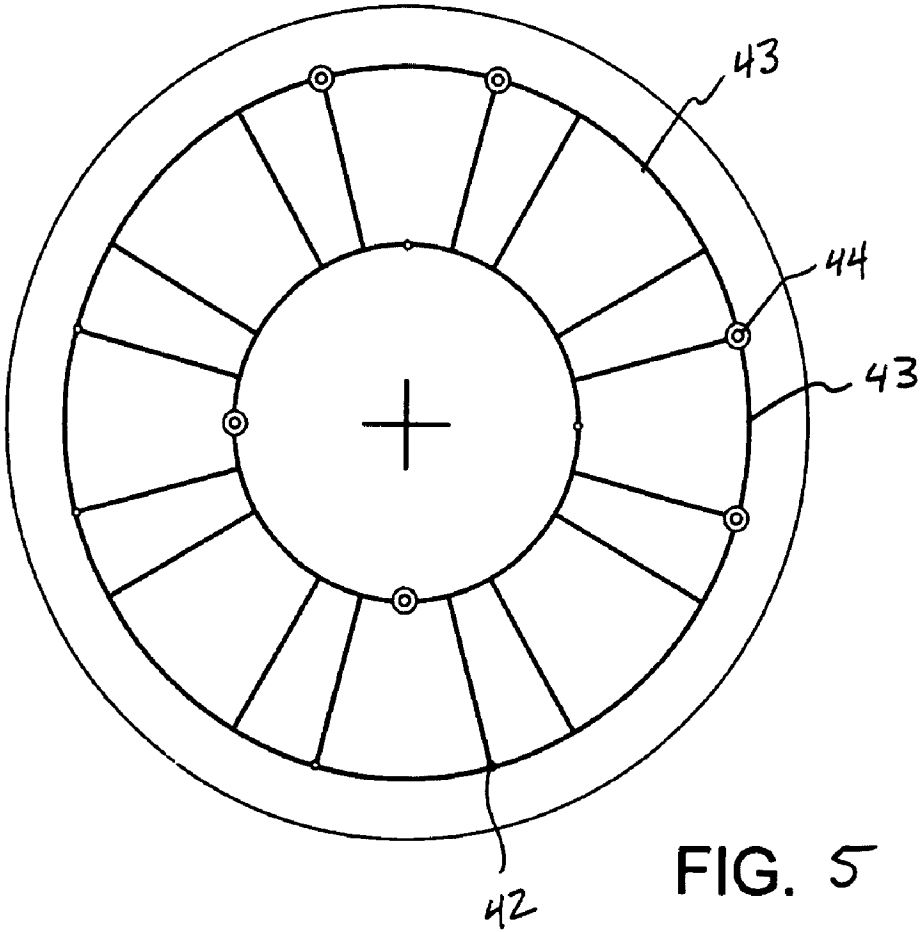
FIG. 5 is a top plan view of a plate of the cover structure.
Figure 6:
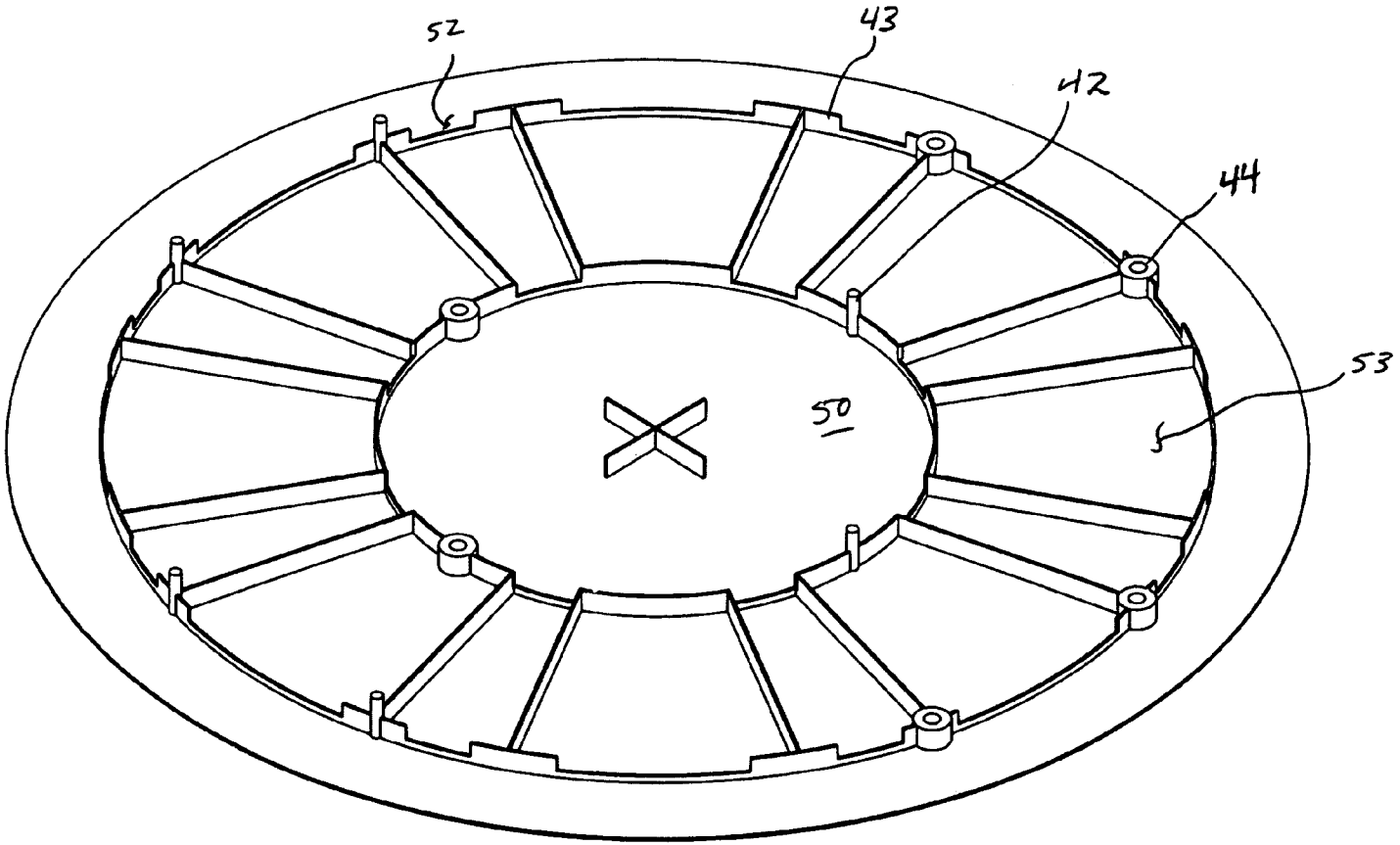
FIG. 6 is a perspective view of the plate of the cover structure.

With additional reference to FIGS. 5 and 6, each of plates 22 and 23, in this preferred embodiment, are substantially identical. Sockets 44 receive posts 42 of the opposing plate. In this manner, plates 22 and 23 can be coupled together with posts 42 received by corresponding sockets 44. Fasteners such as screws, nails, clips, and the like, adhesives, pressure fastener, weld, etc. can be used to join plates 22 and 23. The particular placement of the posts and sockets illustrated allow plates 22 and 23 to be formed identically and still joined and fully supported. This particular configuration allows plates 22 and 23 to be fabricated using injection molding and a single design. Employing a single design for both plates greatly reduces fabrication costs and enables a high rate of fabrication. Plastic material such as polypropylene, high density polyethylene, and the like, are preferably employed to reduce costs of manufacture, to provide a desirable specific gravity as will be discussed presently, and to provide a durable structure to withstand sun, water and weather. The materials used can, and preferably do, incorporate ingredients which increase UV resistance and are preferably white in color to reduce absorption of heat energy from the sunlight. While plastic is preferred, it will be understood that other materials can potentially be employed with these considerations in mind.

Cover structure 20 is also fabricated to insure proper depth within body of water. This is accomplished by ensuring cover structure 20 has a desired specific gravity. The specific gravity of cover structure 20 is such that plate 22 or plate 23 is maintained in a position covering a portion of the surface of a body of water, and maintaining the other of plate 22 and plate 23 below the surface of the body of water. Thus, the specific gravity of cover structure 20 is less than the specific gravity of the fluid in the body of water. It will be understood that either plate can be submerged or on the surface since plates 22 and 23 are identical. This permits cover structure 20 to be placed in a body of water without regard to orientation. The submerged plate acts as an anchor while the other plate covers the surface. By adjusting the specific gravity, the level at which cover structure 20 floats can be adjusted. The desired level is with the upper plate lying on the surface of the water with the inner surface as close to the surface of the body of water as possible. This reduces the effect of wind on structure 20. With one of plates 22 and 23 lying on the surface of the water, cover structure 20 is stable in sustained winds of 55-75 mph. In some instances, water having other materials in it through waste reclamation, salt water, or other impurities, may require an adjustment to the specific gravity.

Figure 7:
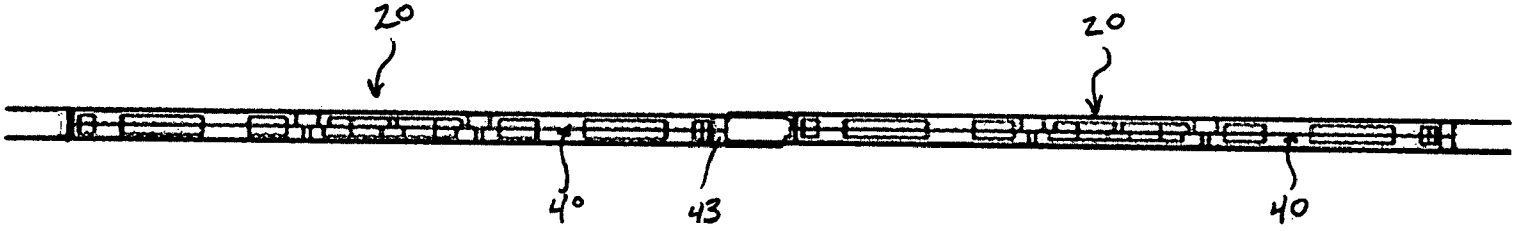
FIG. 7 is a side view illustrating adjacent cover structures.
Figure 8:
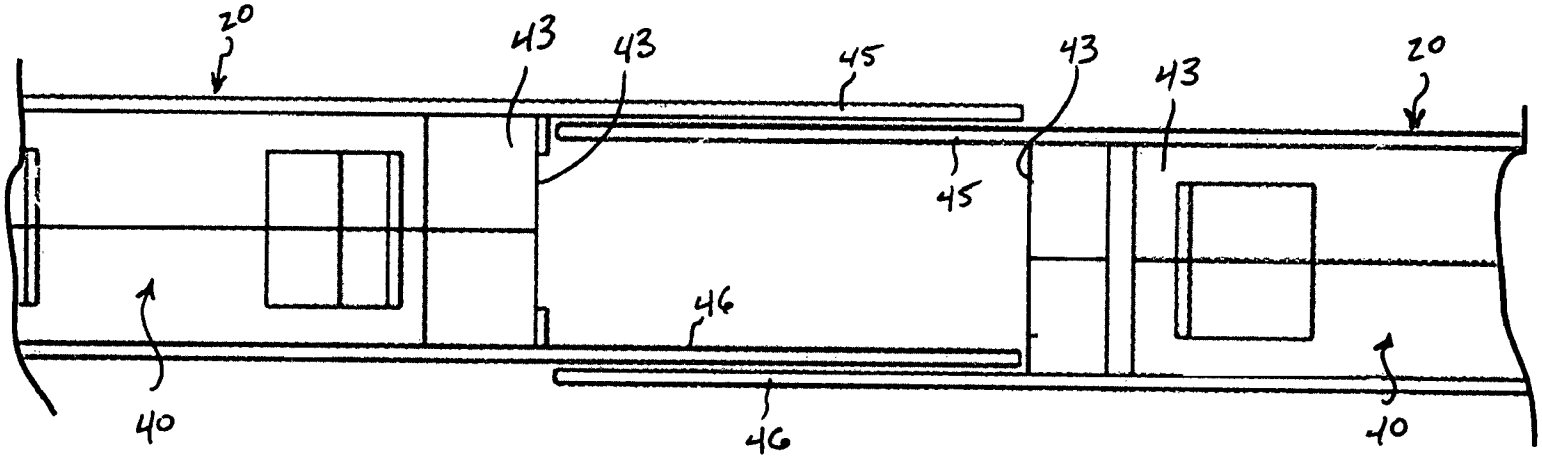
FIG. 8 is an enlarged partial view illustrating overlapping brims of adjacent cover structures.

Still referring to FIGS. 2-6, with additional reference to FIGS. 7 and 8, cover structure 20 also includes limiting means as a portion of support structure 40. The limiting means is intended to limit overlap between plates 22 and 23 of adjacent cover structures 20. While overlap is desirable to insure complete coverage of the surface of the body of water and to create friction between overlapping portion to facilitate formation of a generally stable cover assembly 10, excessive overlap is a waste of materials. Limiting means, according to the present invention, is a structure between plates 22 and 23 which permit overlap to a specific maximum, and can include posts, walls and the like. In this preferred embodiment, the limiting means includes wall 43. Wall 43 extends between inner surface 28 of plate 22 and inner surface 32 of plate 23 and is spaced inwardly from perimetric edges 30 and 35 to define brim portions 45 and 46, respectively. It is the width of brims 45 and 46 which define a maximum overlap between adjacent cover structures. As can be seen, one half of each of walls 43 extends from plate 22 and 23 to facilitate ease in manufacturing as discussed previously. It should be understood that walls 43 can also be fabricated, each in their entirety vertically, but with gaps filled by corresponding walls in the other plates, similar in manner to the posts and sockets.

Referring specifically to FIGS. 2, 5 and 6, an interior volume 50 is defined by plate 22, plate 23 and walls 43. Wall 43 has apertures 52 formed therein (FIG. 3) for allowing ingress and egress of water from interior volume 50. Permitting flow of water into and out of cover structure 20 prevents rocking and tilting of cover structure 20, uneven weight distribution, and insures a constant specific gravity. Interior volume 50 can be further divided, as illustrated, into a plurality of chambers 53. Chambers 53 can limit the ingress and egress of water as desired by placement of dividing walls between plates 22 and 23, and by the placement of apertures 52 allowing communication between the body of water and the interior of chambers 53. These chambers can also contain material affecting the specific gravity of cover structure 20. As an example, some or all of chambers 53 can contain foam materials, or even just air to adjust the specific gravity of cover structure 20 to that of the water or water mixture in which it is dispensed.

Figure 9:
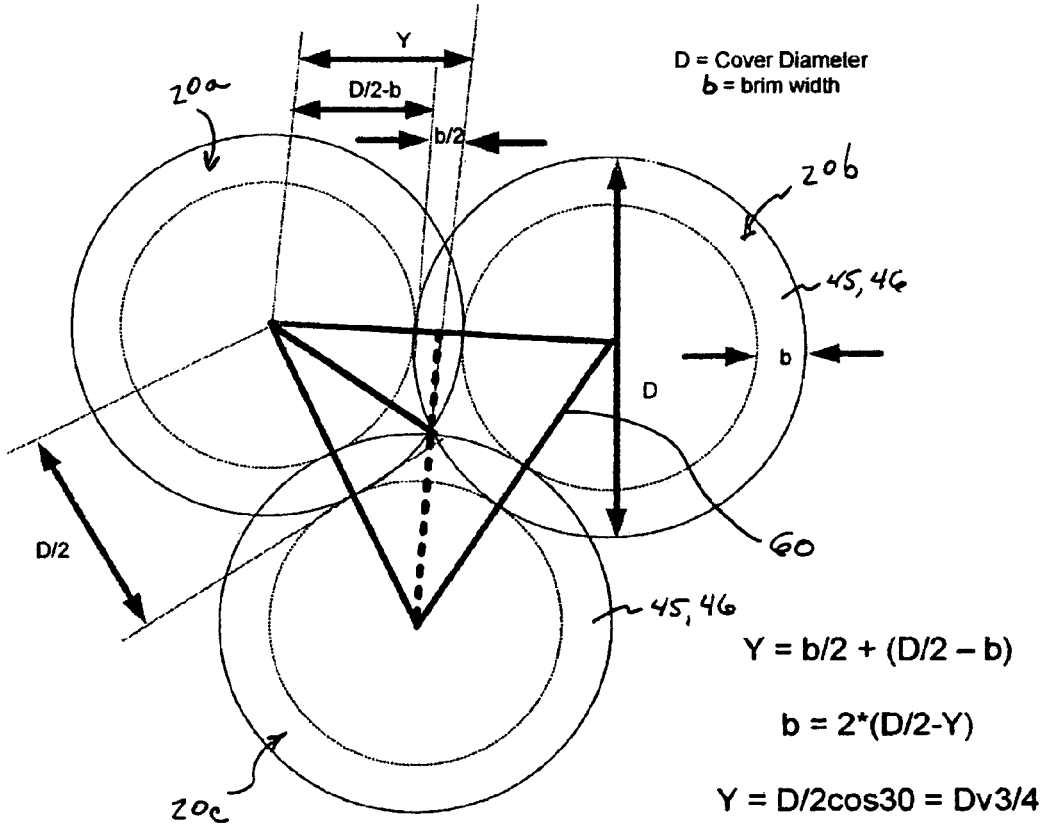
FIG. 9 is a simplified schematic of adjacent cover structures and formulation to calculate brim width to enable complete surface coverage.

With additional reference to FIG. 9, it can be seen that any three adjacent cover structures 20*a*, 20*b*, 20*c* form a triangle 60. The width of each brim 45 and 46 can be calculated to determine the optimal width to provide no-gap coverage of a surface while avoiding wasted overlap. This calculation is accomplished with the following formula:

$$Y=b/2+(D/2-b)$$

$$b=2*(D/2-Y)$$

$$Y=D/2\cos 30=D\sqrt{3}/4$$

$$b=2(D/2-D*\sqrt{3}/4)$$

$$b=0.133975*D$$

Thus, for optimum coverage with the least excess coverage, the width of brims 45 and 46 is 0.133975 times the diameter of plates 22 and 23.

Various changes and modifications to the embodiments herein chosen for purposes of illustration will readily occur to those skilled in the art. To the extent that such modifications and variations do not depart from the spirit of the invention, they are intended to be included within the scope thereof, which is assessed only by a fair interpretation of the following claims.

Having fully described the invention in such clear and concise terms as to enable those skilled in the art to understand and practice the same, the invention claimed is:

1. A cover structure for covering a portion of a surface of a body of water, comprising:

a first plate having a brim;

a second plate having a brim, the second plate overlying and spaced apart from the first plate;

a support structure coupling the first plate to the second plate, wherein the brim portion of the first plate and the brim portion of the second plate define a maximum overlap with an adjacent cover structure; and the cover structure having a specific gravity for maintaining the second plate in a position covering a portion of the surface of a body of water, and maintaining the first plate below the portion of the surface of the body of water.

2. A cover structure as claimed in claim 1 wherein the adjacent cover structure comprises:

a first plate having a brim;

a second plate having a brim, the second plate overlying and spaced apart from the first plate;

a support structure coupling the first plate to the second plate; and the adjacent cover structure having a specific gravity for maintaining the second plate in a position covering a portion of the surface of a body of water, and maintaining the first plate below the portion of the surface of the body of water.

3. A cover structure as claimed in claim 2 further including limiting means for limiting overlap of the brim of the first plate and the brim of the second plate of the cover structure with the brim of first plate and the brim of the second plate of the adjacent cover structure, beyond the maximum overlap.

4. A cover structure for covering a portion of a surface of a body of water, comprising:

a first plate having an inner surface, an opposing outer surface, and a perimetric edge;

a second plate having a inner surface, an opposing outer surface, and a perimetric edge, the second plate overlying the first plate with the inner surface of the first plate facing the inner surface of the second plate in a spaced apart relationship;

a support structure extending between the inner surface of the first plate and the inner surface of the second plate and fixing the first plate to the second plate, the support structure spaced inwardly from the perimetric edge of the first plate and the support structure spaced inwardly from the perimetric edge of the second plate, the support structure including limiting means for limiting overlap between first plates and second plates of adjacent cover structures; and a specific gravity of the cover structure for maintaining one of the first plate and the second plate in a position covering a portion of the surface of a body of water, and maintaining the other of the first plate and the second plate below the portion of the surface of the body of water.

5. A cover structure as claimed in claim 4 wherein the limiting means includes a wall extending between the inner surface of the first plate and the inner surface of the second plate, the wall spaced inwardly from the perimetric edge of the first plate to define a brim portion of the first plate and the wall spaced inwardly from the perimetric edge of the second plate to define a brim portion of the second plate, the brim portion of the first plate and the brim portion of the second plate defining a maximum overlap between adjacent cover structures.

6. A cover structure as claimed in claim 5 further comprising an interior volume defined by the first plate, the second plate and the wall, the wall having at least one aperture therein for allowing ingress and egress of water from the interior volume.

7. A cover structure as claimed in claim 6 wherein the interior volume is divided into chambers.

8. A cover structure as claimed in claim 7 wherein the chambers contain material affecting the specific gravity of the cover structure.

9. A cover structure as claimed in claim 5 wherein the first plate and the second plate are generally circular and the maximum overlap is approximately 0.133975 times a diameter of one of the first plate and the second plate.

10. A cover structure as claimed in claim 4 wherein the support structure further includes posts.

11. A cover structure as claimed in claim 4 wherein the specific gravity of the cover structure is less than the specific gravity of water.

12. A cover assembly for covering a surface of a body of water comprising:

a first cover structure including a first plate overlying and spaced apart from a second plate, a support structure coupling the first plate to the second plate, the first plate having a brim and the second plate having a brim, the first cover having a specific gravity for maintaining the first plate in a position covering a portion of the surface of a body of water, and maintaining the second plate below the portion of the surface of the body of water;

a second cover structure positioned adjacent the first cover structure, the second cover structure including a first plate overlying and spaced apart from a second plate, a support structure coupling the first plate to the second plate, the first plate having a brim and the second plate having a brim, the second cover having a specific gravity for maintaining the first plate in a position covering an adjacent portion of the surface of the body of water, and maintaining the second plate below the adjacent portion of the surface of the body of water; and the brim of the first plate of the first covering and the brim of the second plate of the first cover overlapping the brim of the first plate of the second covering and the brim of the second plate of the second cover.

13. A cover assembly as claimed in claim 12 wherein the first cover structure and the second cover structure each further include limiting means for limiting overlap of the brim of first plate and the brim of the second plate of the first cover structure with the brim of the first plate and the brim of the second plate of the second cover structure.

14. A cover assembly as claimed in claim 13 wherein the limiting means of each cover structure includes a wall extending between the first plate and the second plate to define the brim portion of the first plate and the second plate.

15. A cover assembly as claimed in claim 14 wherein each cover structure further comprising an interior volume defined by the first plate, the second plate and the wall, the wall having at least one aperture therein for allowing ingress and egress of water from the interior volume.

16. A cover assembly as claimed in claim 15 wherein the interior volume of each cover structure is divided into chambers.

17. A cover assembly as claimed in claim 16 wherein the chambers of each cover structure contain material affecting the specific gravity of the cover structure.

18. A cover assembly as claimed in claim 12 wherein the first plate and the second plate of each cover structure are generally circular and the brims are approximately 0.133975 times a diameter of one of the first plate and the second plate.

* * * * *